US005961238A

United States Patent [19]

de Bruin et al.

[11] Patent Number: 5,961,238

[45] Date of Patent: Oct. 5, 1999

[54] CONTAINER FOR A FLUID PRODUCT

[75] Inventors: Marco de Bruin, Ja Wijk bij Duurstede; Mark Brouwer, LN Heesch, both of Netherlands

[73] Assignee: Henkel Kommanditgesellschaft auf Aktien, Duesseldorf, Germany

[21] Appl. No.: 08/952,034

[22] PCT Filed: Apr. 29, 1996

[86] PCT No.: PCT/EP96/01785

§ 371 Date: Dec. 8, 1997

§ 102(e) Date: Dec. 8, 1997

[87] PCT Pub. No.: WO96/34546

PCT Pub. Date: Nov. 7, 1996

[30] Foreign Application Priority Data

May 6, 1995 [DE] Germany ..... 195 16 764

[51] Int. Cl.[6] ..... A46B 11/00; A45D 40/00

[52] U.S. Cl. ..... 401/122; 401/129

[58] Field of Search ..... 401/122, 129

[56] References Cited

U.S. PATENT DOCUMENTS

| | | | |
|---|---|---|---|
| 2,703,898 | 3/1955 | Kellett | 15/121.3 |
| 3,529,899 | 9/1970 | Gruska | 401/121 |
| 3,662,769 | 5/1972 | Vasas et al. | 132/88.7 |
| 3,756,731 | 9/1973 | Aubry | 401/122 |
| 4,705,053 | 11/1987 | Goncalves | 401/122 X |
| 5,190,389 | 3/1993 | Vasas | 401/122 |
| 5,490,737 | 2/1996 | Gueret | 401/122 |

FOREIGN PATENT DOCUMENTS

| | | |
|---|---|---|
| 0 002 301 | 6/1979 | European Pat. Off. . |
| 0 202 932 | 11/1986 | European Pat. Off. . |
| 1 494 767 | 9/1967 | France . |
| 2 330 353 | 6/1977 | France . |
| 17 57 096 | 1/1971 | Germany . |
| 37 04 496 | 10/1987 | Germany . |
| 87 13 273 | 3/1988 | Germany . |
| 92 05 308 | 8/1992 | Germany . |
| 2 082 553 | 3/1982 | United Kingdom . |
| WO95/11839 | 5/1995 | WIPO . |

*Primary Examiner*—Steven A. Bratlie

*Attorney, Agent, or Firm*—Ernest G. Szoke; Wayne C. Jaeschke; Kenneth Watov

[57] ABSTRACT

A container for a free-flowing product, in particular a correcting fluid, has an opening provided with a removable closure cap with an integrated brush-shaped applicator. A sleeve-shaped stripper is positioned in the opening and includes stripping strips whose ends are elastically supported against each other and at least partially close the open cross section of the stripper. Product is perfectly dosed from the container even over a long time and losses of the volatile fraction of the product in the container are largely avoided when opening the container and removing product therefrom, via a brush-shaped applicator provided in the area of its stem with a continuous notch in which the free ends of the stripping strips are engaged when the closure cap is installed on the container.

4 Claims, 2 Drawing Sheets

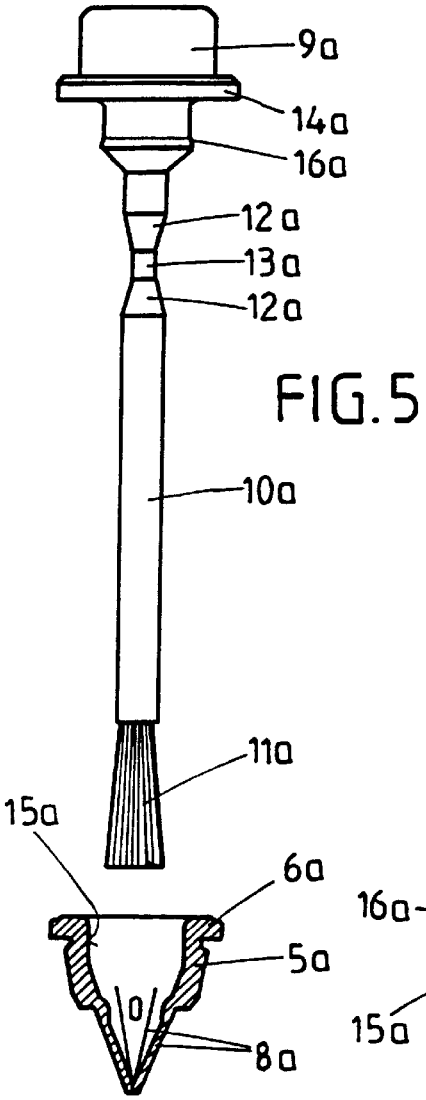
FIG. 5
FIG. 6
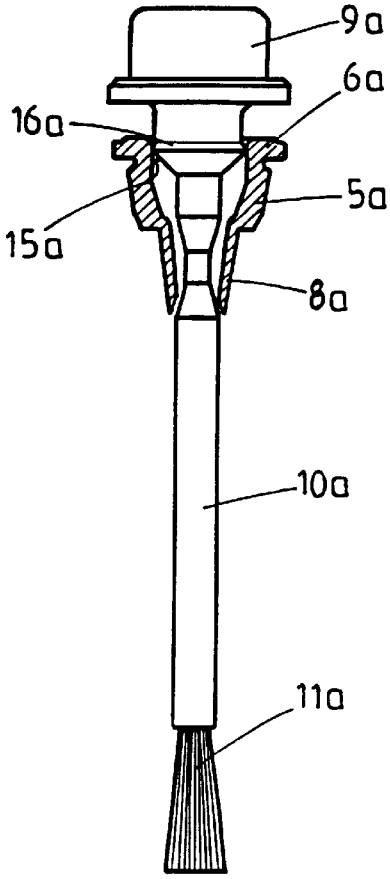
FIG. 7
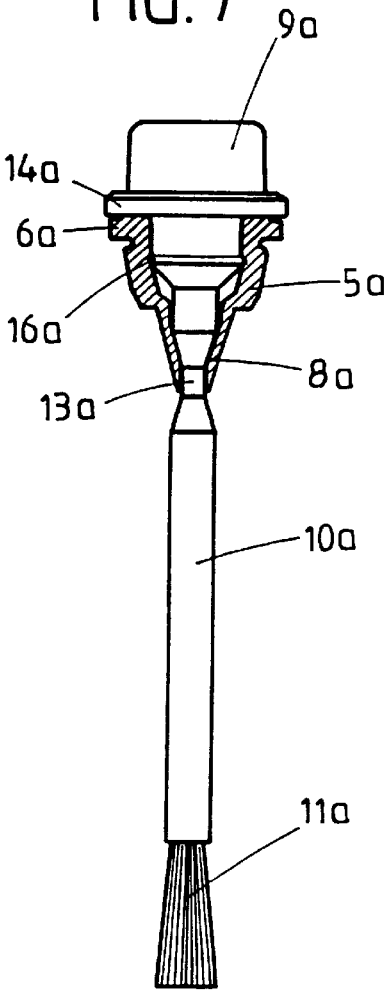

CONTAINER FOR A FLUID PRODUCT

BACKGROUND 1.0 Field of the Invention

This invention relates generally to a container for a fluid product, more particularly correcting fluid, comprising an opening which is provided with a removable closure cap with an integrated brush-like applicator, and into which opening is inserted a mechanism for at least partially closing off the opening after the applicator is removed.

2.0 Discussion of Related Art

Containers for correcting fluid have been known for some time. To remove correcting fluid and apply it to paper, the closure cap is unscrewed so that the integral brush-like applicator is removed from the container, the tip of the brush automatically being guided along a sleeve-like stripper which enables the amount of fluid removed to be controlled to a certain extent. However, after repeated use, the fluid can no longer be satisfactorily stripped at such a stripper. Instead, the passage cross-section of the stripper gradually becomes blocked after prolonged use of the container so that removal of the brush-like applicator and stripping of the brush end and re-insertion thereof without damage are made increasingly difficult or even impossible.

In addition, such containers are a disadvantage where solvent-containing fluids are used. This is because, under the effect of temperature and the reduction in the volume of fluid through consumption, the ratio by volume of fluid space to vapor space above the fluid in the container changes during use. Accordingly, part of the solvent vapor escapes to an increasing extent each time the container is opened. The loss of solvent leads to the deleterious effects mentioned previoulsy.

DE 87 13 273 U1 describes a container in which the sleeve-like stripper is in the form of a separating tube which extends to the bottom of the container and which is formed at its lower end with relatively small fluid throughflow openings. Accordingly, the separating tube dips into the fluid accommodated in the container and, in doing so, is intended to separate the vapor space above the surface of the fluid from the removal opening of the container. This is supposed to prevent vapor mixtures of high solvent content from being directly driven out from the vapor space above the fluid and hence from the container by the pumping effect of the brush-like applicator dipping into the fluid. However, the separating tube does not act as a stripper so that it is virtually impossible to remove measured amounts of fluid from the container with the brush-like applicator. Stripping is only possible at the upper rim of the opening which becomes soiled and sticky. In addition, the fluid throughflow openings towards the lower edge of the separating tube can easily become blocked so that satisfactory flow of the fluid from the actual container space into the separating tube is no longer guaranteed.

Another prior container of interest is taught in WO 95/11839. This container has a sleeve-like stripper with strip-like stripping laps which bear resiliently against one another on their inner surfaces and which at least locally close the passage cross-section of the stripper. The stripping laps bear against the brush-like applicator on all sides and, when the brush-like applicator is withdrawn from the container, lead to stripping of the fluid on all sides so that only a measured amount of fluid is present on the tip of the brush. Although a container of this type is capable in principle of avoiding the problems mentioned above, it has been found that the strip-like stripping laps, which are normally made of plastic in such containers, gradually lose their resiliency because, when the container is not in use, i.e. when the brush-like applicator is fully inserted, the resilient stripping laps are permanently bent outwards against the spring force. The result of this is that the stripping effect of the stripping laps and their sealing effect increasingly diminish over a prolonged period and, after a certain time, their sealing effect can no longer be guaranteed when the container is opened. A similar solution with the same disadvantages is known from DE 92 05 308 U1.

3.0 Summary of the Invention

Accordingly, one object of the present invention is to improve a container for correction fluid in question in such a way that, even over a prolonged period, satisfactory, measured removal of the fluid is guaranteed and losses of vaporous product present in the container are largely avoided when the container is opened to remove fluid.

Another object of the invention is to provide a container for correction fluid which is characterized in that the brush-like applicator is provided at its stem with an encircling indentation in which the free ends of strip-like stripping laps engage when the closure cap is in place.

The design of the present container ensures that satisfactory, measured removal of the fluid and protection against the unwanted escape of vaporous product from the container are guaranteed, even after prolonged use. In a preferred embodiment of the invention for the configuration of the brush-like applicator, the outward bending of the stripping laps are minimized against their spring force when the closure cap is in place and the brush-like applicator is fully inserted, with the result that the stripping laps are in a quasi of rest position and can relax for effectively sealing the passage opening, i.e. bear sufficiently resiliently against one another to provide a seal, when the closure cap is removed, even after prolonged use of the container. The result of this is that the stripping laps remain effective, i.e. perform both their stripping function and their sealing function, even after prolonged use of the container. This affords the major advantage of the invention, particularly for solvent-containing fluids, that, immediately after removal of the brush-like applicator, the stripping laps bear resiliently against one another at their ends and almost completely close the passage cross-section of the sleeve-like stripper. Small gaps are largely closed by the vapor pressure of the fluid in the container so that the escape of vaporous product, particularly solvent vapor, is reliably avoided.

In order to obtain substantially complete sealing of the passage cross-section of the stripper, the strip-like stripping laps preferably form a continuous cone in the closed position.

In another preferred embodiment of the invention, the sleeve-like stripper is cylindrical at its insertion end while the brush-like applicator is provided with an encircling sealing surface which co-operates sealingly with the cylindrical part of the stripper. This affords the major additional advantage that the container is tightly closed even when the closure cap has accidentally not been fully screwed onto the container. This is because, when the brush-like applicator is inserted into the container through the stripping laps, the encircling sealing surface of the applicator comes into sealing contact with the cylindrical insertion section of the sleeve-like stripper through corresponding arrangement even before the closure cap has been fully screwed on. This prevents any escape of fluid before the cap is screwed onto the container.

BRIEF DESCRIPTION OF THE DRAWINGS

The invention is described by way of example in the following with reference to the accompanying drawings, in which like items are identified by the same reference designation, wherein:

FIG. 5 is a front elevational view, partly in section, of another embodiment of a stripper and a closure cap with a brush-like applicator in the open position, i.e. with the closure cap removed.

FIG. 6 shows the closure cap illustrated in FIG. 5 during insertion of its brush-like applicator into the stripper.

FIG. 7 shows the closure cap with its brush-like applicator in the embodiment illustrated in FIGS. 5 and 6 fully inserted into the stripper.

DETAILED DESCRIPTION OF THE INVENTION

Figure 1:
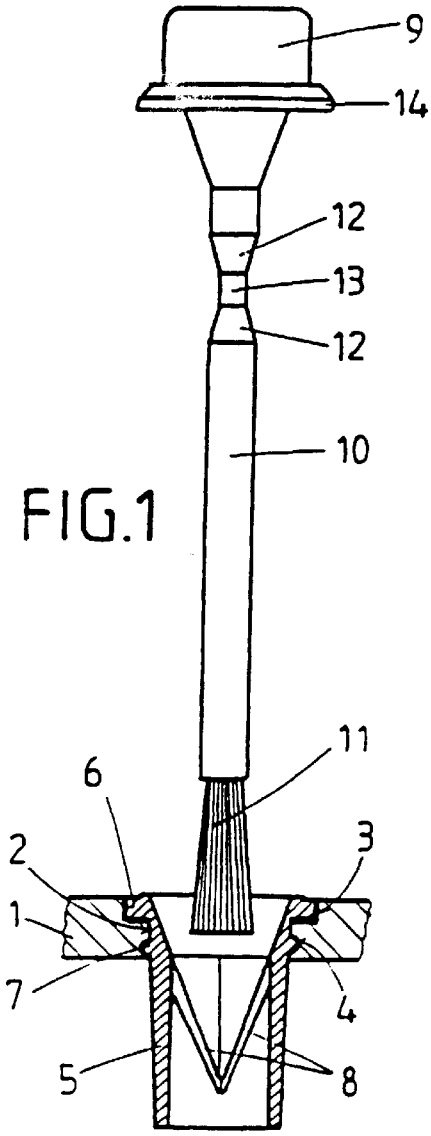
FIG. 1 is a front elevational view, partly in section, of part of a container according to the invention with its stripper and closure cap plus integral brush-like applicator in the open position, i.e. with the closure cap removed.

Only those portions of the container which are crucial to the invention are shown. Of the actual container, only the upper portion 1 is shown. The container has an opening 2 which has a larger diameter towards the outside and thus forms a supporting shoulder 3. In addition, the opening 2 is formed on its inner wall with an encircling annular groove 4. The object of this configuration of the opening 2 of the container 1 is firmly to receive a sleeve-like stripper 5 which, to this end, has an upper rest shoulder 6 and an encircling snap bead 7. Accordingly, when the sleeve-like stripper 5 is inserted into the opening 2, the bead 7 snaps into the groove 4 and the upper rest shoulder 6 rests on the supporting shoulder 3 of the opening 2. In the region of the opening 2, the container 1 may assume the form of a tubular extension of the actual container body (not shown) although this has not been shown in detail.

The sleeve-like stripper 5 is provided with conically tapering strip-like stripping laps 8 which bear resiliently against one another at their ends. The stripping laps 8 are formed internally on the inner wall of the sleeve-like stripper 5 at the upper end thereof and, in the position shown in FIGS. 1 and 2, form a substantially continuous cone which almost completely closes the passage opening of the sleeve-like stripper 5.

Figure 4:
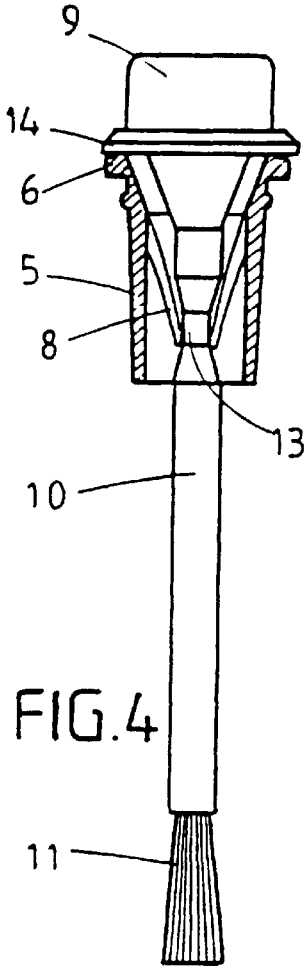
FIG. 4 is a view corresponding to FIGS. 1 and 3 showing the closure cap and brush-like applicator fully inserted into the stripper.

In addition, the container 1 comprises a removable closure cap 9 with an integrated, i.e. one-piece, brush-like applicator 10 of having a brush tip 11. At its stem, the brush-like applicator 10 comprises an encircling indentation 13 which is formed by conical tapers 12 on either side which function as described below.

Where it becomes the brush-like applicator 10, the closure cap 9 comprises a rest shoulder 14 with which it rests on the surface of the container or rather on the rest shoulder 6 of the stripper 5 after it has been screwed onto the container (FIG. 4). At the rest shoulder 14, the closure cap 9 may even merge into an internally screwthreaded sleeve-like section (not shown) and may be screwed onto an externally screwthreaded tubular extension of the container 1 containing the opening 2 (see FIG. 1), as known per se with containers for correction fluid.

Figure 2:
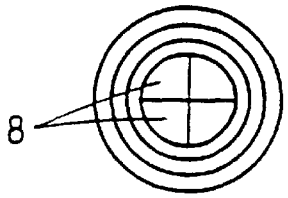
FIG. 2 is a plan bottom view of the stripper shown in FIG. 1.

In FIG. 1, the container 1 is shown in its open position, i.e. with the closure cap 9 removed. In this position, the passage opening of the stripper 5 is closed because the strip-like stripping laps 8 bear substantially tightly against one another under their inherent spring tension. Accordingly, no product, particularly solvent vapor or the like, is able to escape from the container 1 in this position.

Figure 3:
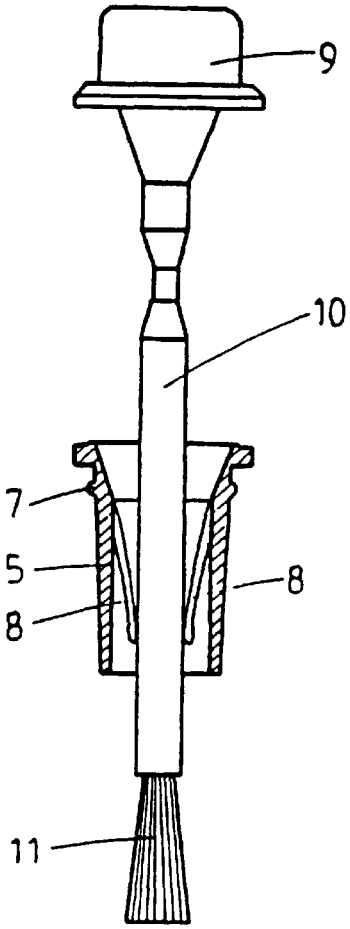
FIG. 3 is a view corresponding to FIG. 1 showing the closure cap during insertion of its brush-like applicator into the stripper.

To reclose the container 1, the brush-like applicator 10 of the closure cap 9 is inserted into the stripper 5, as shown in FIG. 3, so that the strip-like stripping laps 8 are forced apart against their spring tension and form an insertion opening.

When the closure cap 9 is fully in place, so that the brush-like applicator 10 is fully inserted into the container and hence through the stripper 5 (FIG. 4), the free ends of the stripping laps 8 are located in the vicinity of the indentation 13 at the stem of the brush-like applicator 10. The resilient stripping laps 8 are thus able to relax slightly inwards from their fully open position. At the same time, the brush-like applicator 10 and hence the closure cap 9 are also held in the closed position at the container opening so that, as mentioned above, the closure cap 9 does not have to be conventionally equipped with a screwthreaded sleeve. In that case, an originality seal merely has to be provided on the closure cap 9, being removed before the container 1 is opened for the first time.

To open the container 1 to remove fluid, the reverse procedure is adopted. The fluid adhering to the tip 11 of the brush-like applicator is uniformly stripped off on all sides as the brush passes between the free ends of the stripping laps 8 so that only a precise and required amount of fluid is available on the brush-like applicator 10, and can be satisfactorily applied to paper or the like without any danger of dripping.

FIGS. 5 to 7 show a modified embodiment of the invention, the same reference numerals as in FIGS. 1 to 4 being followed by the letter "a" where they relate to the same parts.

This embodiment is distinguished from the embodiment described above in that it additionally comprises an escape guard which prevents the unwanted escape of fluid from the container even if the closure cap is not fully screwed onto the container. In these embodiments, the sleeve-like stripper 5*a* has a cylindrical insertion section 15*a* while the brush-like applicator 10*a* is provided with an encircling sealing surface 16*a* which co-operates sealingly with the cylindrical section 15*a* of the stripper 5*a*, as will be described hereinafter. The sealing surface 16*a* is located above the indentation 13*a*.

If the closure cap 9*a* with the brush-like applicator 10*a* is inserted into the stripper 5*a*, as shown in FIG. 6, the sealing surface 16*a* comes into sealing contact with the cylindrical insertion section 15*a* of the stripper 5*a*. This means that adequate sealing against the unwanted escape of fluid from the container is guaranteed even if the closure cap 9*a* is not fully screwed onto the container. The closure cap 9*a* is shown in its fully screwed-on position in FIG. 7. In this position, the rest shoulder 14*a* of the closure cap 9*a* rests on the shoulder 6*a* of the stripper 5*a*. Even in this fully screwed-on position, the sealing surface 16*a* additionally contributes towards the sealing of the container.

Although various embodiments of the invention have been shown and described, they are not meant to be limiting. Those of skill in the art may recognize certain modifications to these embodiments, which modifications are meant to be covered by the spirit and scope of the appended claims. For example, the stripper 5 may also be an integral part of the container 1, etc.

What is claimed is:

1. A container for a fluid product comprises a top opening which is provided with a removable closure cap with an integrated brush-like applicator and into which is inserted a sleeve-like stripper provided with resilient strip-like stripping laps, the brush-like applicator being formed by an elongated stem having a first end integral with a central portion of a bottom of said cap, a brush being rigidly attached to a second end of said stem, an encircling indentation formed by conical tapers on either side proximate the first end of said stem, whereby the free ends of the strip-like stripping laps engage said indentation, with inside portions of said laps resting adjacent the uppermost conical taper, for retaining said laps partially inward from their fully open position when the closure cap is in place, whereby as said closure cap is removed the lowermost conical taper spreads said laps to the diameter of the underlying stem portion preparatory to closing upon said brush as it passes therebetween, and further including the ends of the stripping laps bearing resiliently against one another when the closure cap and brush are removed, for completely closing a passage cross-section of the sleeve-like stripper.

2. A container as claimed in claim 1, wherein the strip-like stripping laps are arranged on an inner wall of the sleeve-like stripper.

3. A container as claimed in claim 1, wherein the sleeve-like stripper has a cylindrical insertion section, and the brush-like applicator is provided with an encircling sealing surface which co-operates sealingly with the cylindrical section of the stripper.

4. A container as claimed in claim 2, wherein the sleeve-like stripper has a cylindrical insertion section, and the brush-like applicator is provided with an encircling sealing surface which co-operates sealingly with the cylindrical section of the stripper.

* * * * *